US011337278B2

(12) United States Patent
Malone et al.

(10) Patent No.: US 11,337,278 B2
(45) Date of Patent: May 17, 2022

(54) ELECTRICAL HEATING CABLE

(71) Applicant: Heat Trace Limited, Frodsham (GB)

(72) Inventors: Neil Malone, Knutsford (GB); Jason Daniel Harold O'Connor, Stockport (GB); Peter Richard Howe, Warrington (GB); Ian James Scott, Glossop (GB)

(73) Assignee: Heat Trace Limited, Frodsham (GB)

( * ) Notice: Subject to any disclaimer, the term of this patent is extended or adjusted under 35 U.S.C. 154(b) by 0 days.

(21) Appl. No.: 16/975,517

(22) PCT Filed: Feb. 25, 2019

(86) PCT No.: PCT/GB2019/050510

§ 371 (c)(1),
(2) Date: Aug. 25, 2020

(87) PCT Pub. No.: WO2019/166786

PCT Pub. Date: Sep. 6, 2019

(65) Prior Publication Data

US 2020/0413497 A1 Dec. 31, 2020

(30) Foreign Application Priority Data

Feb. 28, 2018 (GB) ..... 1803267

(51) Int. Cl.
*H05B 3/34* (2006.01)
*H05B 3/56* (2006.01)

(52) U.S. Cl.
CPC ..... *H05B 3/565* (2013.01); *H05B 2203/035* (2013.01)

(58) Field of Classification Search
CPC ..... H05B 3/145; H05B 3/146; H05B 3/44; H05B 3/56; H05B 3/565; H05B 3/58;
(Continued)

(56) References Cited

U.S. PATENT DOCUMENTS 2,622,152 A * 12/1952 Roschsamuel ..... H01B 11/1808 333/243
3,757,086 A 9/1973 Indoe
(Continued)

FOREIGN PATENT DOCUMENTS

EP 2 324 682 5/2011
EP 2324682 9/2015

OTHER PUBLICATIONS

PCT Search Report for PCT/GB2019/050510 dated Jul. 7, 2019.

*Primary Examiner* — Hung D Nguyen
(74) *Attorney, Agent, or Firm* — Woodard Emhardt Henry Reeves & Wagner LLP

(57) ABSTRACT

An electrical heating cable with a first power supply conductor, a second power supply conductor, and a third power supply conductor. Each of the first, second and third power supply conductors extend along a length of the cable. The electrical heating cable also includes an electrically conductive heating element body, wherein the first, second and third power supply conductors are electrically coupled to each other via the electrically conductive heating element body. The second power supply conductor is provided with a layer of electrically insulating material which covers only a part of a surface of the second power supply conductor. The layer is provided between the surface of the second power supply conductor and the electrically conductive heating element body.

20 Claims, 4 Drawing Sheets

(58) Field of Classification Search
CPC ..... H05B 3/78; H05B 6/56; H05B 2203/019; H05B 2203/02; H05B 2203/026; H05B 2203/035; H05B 2203/036
USPC ..... 219/538, 542, 543, 544, 545, 546, 549, 219/552, 553
See application file for complete search history.

(56) References Cited

U.S. PATENT DOCUMENTS

| | | | | |
|---|---|---|---|---|
| 4,271,350 | A | 6/1981 | Crowley | |
| 4,392,051 | A | 7/1983 | Goss et al. | |
| 4,553,877 | A * | 11/1985 | Edvardsen | H02G 1/00 405/183.5 |
| 4,733,059 | A | 3/1988 | Goss et al. | |
| 6,144,018 | A | 11/2000 | Heizer | |
| 2011/0226754 | A1 | 9/2011 | Malone et al. | |
| 2016/0234884 | A1 | 8/2016 | Kazemi et al. | |
| 2017/0254246 | A1 * | 9/2017 | Chini | H05B 3/0014 |

* cited by examiner

ELECTRICAL HEATING CABLE

CROSS-REFERENCE TO RELATED APPLICATION

This application is a national stage entry of PCT/GB2019/050510 filed Feb. 25, 2019, which claims the benefit of GB 1803267.2 filed Feb. 28, 2018, which are hereby incorporated by reference.

BACKGROUND

The present invention relates to an electrical heating cable. More particularly, but not exclusively, the present invention relates to a balanced three-phase electrical heating cable for use with a three-phase power supply.

Electrical heating cables are used in a wide variety of applications where heating may be required. An electrical heating cable typically includes one or more electrical conductors running along a length of the cable, with a body material between the conductors. The body material provides potential electrical pathways between the electrical conductors, but generally has a resistance much larger than that of the electrical conductors. When the electrical heating cable is in use, the one or more electrical conductors are connected to an electric power supply, and electricity is conducted through the body material via the electrical conductors. In this process, the body material transforms the electrical energy which it conducts to heat for heating up a workpiece.

The electrical heating cable can be used to heat a pipe to ensure that the contents of the pipe are maintained at a certain temperature, for example above the freezing point of the contents. The pipe may be a water pipe, an oil production pipe or any other pipe used for example in an industrial plant. The heating cable maybe in contact with either the inside or outside of the pipe, and may extend along the pipe in a linear fashion or be wound around the pipe. It is common for pipes used across industrial plants to have a length of several kilometres. Therefore electrical heating cables for heating such pipes are required to have a length at least of the same order as the length of the pipes.

National grids, industrial plants, commercial sites and high-power equipment normally operate with three-phase power supplies. Therefore, three-phase electrical heating cables arrangements suitable for use with three-phase power supplies are generally preferable in industrial applications. Three-phase series resistance heating cable arrangements generally can achieve circuit lengths of several kilometres, but cannot self-regulate their temperature and therefore may impose serious safety issues. In contrast, self-regulated heating cables are generally single-phase heating cables. Single-phase heating cables are typically limited to a much shorter circuit length of around 100 metres and are not suitable for use in large-scale industrial applications.

Phase imbalance remains a challenge for the use of three-phase self-regulated electrical heating cables. That is, a three-phase self-regulated electrical heating cable typically has electrically conductive pathways with unequal electrical resistance across the three phases, and accordingly draws unequal currents from each phase of the power supply. In other words, such a heating cable generates unequal power loadings on each phase of a three-phase power supply, and becomes an unbalanced load for the power supply. The phase imbalance reduces the efficiency of the cables themselves, and is also undesirable for the stability of three-phase power supplies.

SUMMARY

It is an object of the present invention, among others, to provide an electrical heating cable, such as a three-phase electrical heating cable, in which the load imbalance across the three phases of the cable is reduced.

According to a first aspect of the present invention, there is provided an electrical heating cable, comprising: a first power supply conductor; a second power supply conductor; a third power supply conductor, wherein each of the first, second and third power supply conductors extends along a length of the cable; an electrically conductive heating element body, wherein the first, second and third power supply conductors are electrically coupled to each other via the electrically conductive heating element body; wherein the second power supply conductor is provided with a layer of electrically insulating material which covers only a part of a surface of the second power supply conductor, the layer being provided between the surface of the second power supply conductor and the electrically conductive heating element body.

By providing a layer of electrically insulating material which covers only a part of a surface of the second power supply conductor, the electrical resistance between the second power supply conductor and other power supply conductors (such as, the first and third power supply conductors) can be easily adjusted. By providing the layer between the surface of the second power supply conductor and the electrically conductive heating element body, the layer is thus configured to limit the proportion of the surface of the second power supply conductor which is electrically coupled to the electrically conductive heating element body. A remaining part of the surface of the second power supply conductor which is uncovered by the layer of electrically insulating material may be electrically coupled to the electrically conductive heating element body.

The electrically insulating material may have a resistivity at least 10 times the resistivity of the electrically conductive heating element body. When the electrically insulating material is 10 times more resistive than the electrically conductive heating element body, phase imbalance within the electrical heating cable can be reduced by around 90%.

The electrically insulating material may have a resistivity at least $10^{10}$ times the resistivity of the electrically conductive heating element body.

The electrically conductive heating element body may have a resistivity of the order of around $10^3$ to $10^4$ Ω·m. The electrically insulating material may have a resistivity of the order of around $10^{15}$ to $10^{16}$ Ω·m.

It will be appreciated that the area of the layer of electrically insulating material directly affects the conductive area of the second power supply conductor which is electrically coupled to the first and third power supply conductors via the electrically conductive heating element body. By enlarging the area of the layer to cover a larger part of the surface of the second power supply conductor, the second power supply conductor has less conductive area which is electrically coupled to other power supply conductors via the electrically conductive heating element body. Accordingly, the resistance between the second power supply conductor and other power supply conductors will increase in proportion with the area of the layer, and vice versa. In this way, the electrical resistance between the second power supply conductor and other power supply conductors can be easily controlled to a desired level, by simply adjusting the area of the layer on the surface. This is advantageous for reducing or even substantially eliminating any imbalance within the electrical heating cable, by achieving balanced conductive pathways (i.e., balanced power loadings) across the first, second and third power supply conductors, thereby allowing the electrical heating cable to work more efficiently when the cable is connected to, for example, an industrial three-phase power supply.

It will be appreciated that the layer of electrically insulating material may be referred to as a coating of electrically insulating material which is applied to coat a part of the surface of the second power supply conductor. Therefore, the expression "a layer of electrically insulating material" may be used interchangeably with the expression "a coating of electrically insulating material". The layer of electrically insulating material may be in contact with the surface of the second power supply conductor. Further or alternatively, the layer of electrically insulating material may be in contact with the electrically conductive heating element body.

It will be understood that the layer of electrically insulating material does not need to be in direct contact with the surface of the second power supply conductor. Similarly, the layer of electrically insulating material does not need to be in contact with the electrically conductive heating element body. For example, a first intermediate layer may be provided between the layer of electrically insulating material and the surface of the second power supply conductor. The first intermediate layer may comprise an adhesive layer which makes the layer of electrically insulating material adhere to the surface of the second power supply conductor. Further, the first intermediate layer may comprise a layer of electrically conductive material, which is electrically coupled to the second power supply conductor.

Similarly, a second intermediate layer may be provided between the layer of electrically insulating material and the electrically conductive heating element body. The second intermediate layer may comprise a layer of electrically conductive material, which is electrically coupled to the electrically conductive heating element body.

The second power supply conductor may be spaced from the first power supply conductor by a first distance, and may be spaced from the third power supply conductor by a second distance. The first power supply conductor may be spaced from the third power supply conductor by a third distance. The third distance may be greater than the first distance and the second distance.

By arranging the third distance to be greater than the first distance and the second distance, the electrical resistance between the first and third power supply conductors tends to be larger than the electrical resistance between the first and second power supply conductors and the electrical resistance between the second and third power supply conductors (if the layer of electrically insulating material is not provided). However, by providing the layer of electrically insulating material which covers only a part of the surface of the second power supply conductor, the layer has the effect of increasing the electrical resistance between the first and second power supply conductors and the electrical resistance between the second and third power supply conductors, thereby allowing the electrical resistances between each pair of the three power supply conductors to reach approximately the same level and making the electrical heating cable balanced.

The first, second and third power supply conductors may be embedded in the electrically conductive heating element body.

The first, second and third power supply conductors may be entirely surrounded by the electrically conductive heating element body at an active heating region of the electrical heating cable.

It will be appreciated that the active heating region is a region of the electrical heating cable which extends along a length of the cable and generates heat for heating up a workpiece. The active heating region may form a main body of the electrical heating cable. It will further be appreciated that the electrical heating cable may further comprise a connection region for connecting to a power supply, and the connection region may be provided at an end of the active heating region. At the connection region, the first, second and third power supply conductors may extend beyond the electrically conductive heating element body, in order to connect to the power supply.

The first, second and third power supply conductors may be not directly connected to one another. That is, the only available electrically conductive pathways between the first, second and third power supply conductors may be via the electrically conductive heating element body.

The first, second and third power supply conductors may extend alongside one another in a substantially planar arrangement.

By arranging the first, second and third power supply conductors to extend alongside one another in a substantially planar arrangement, it increases the flexibility of the electrical heating cable, thereby reducing the bending stresses generated within the cable during installation of the cable around a workpiece to be heated, and accordingly prolonging the lifespan of the cable. Further, the substantially planar arrangement allows the cable to have a relatively flat cross-sectional shape, thereby increasing the contact area between the cable and the workpiece. In this way, the substantially planar arrangement allows more efficient heat transfer between the electrically conductive heating element body of the cable and the workpiece to be heated.

The second power supply conductor may be located between the first and third power supply conductors.

The first and third power supply conductors may be equally spaced from the second power supply conductor.

It will be appreciated that when the first and third power supply conductors are equally spaced from the second power supply conductor, the third distance is approximately two times the first distance, with the first distance being equal to the second distance.

The layer of electrically insulating material may cover substantially 50% of the surface of the second power supply conductor.

By arranging the layer of electrically insulating material to cover substantially 50% of the surface of the second power supply conductor, the electrical resistance between the second power supply conductors and other power supply conductors (such as, the first and third power supply conductors) is increased to approximately two times their original value where there is no layer of electrically insulating material provided. This allows the electrical resistances between each pair of the three power supply conductors to reach approximately the same levels and accordingly reduces any phase imbalance within the electrical heating cable. It will be appreciated that the layer with substantially 50% coverage is preferable when the first and third power supply conductors are equally spaced from the second power supply conductor.

The surface of the second power supply conductor may comprise a plurality of first sections and a plurality of second sections arranged in an alternating manner along a length of the second power supply conductor, wherein the plurality of first sections are covered by the layer of electrically insulating material and the plurality of second sections are not covered by the layer of electrically insulating material.

It will be appreciated that the plurality of second sections are electrically coupled to the first and third power supply conductors via the electrically conductive heating element body, and that the plurality of first sections are not electrically coupled to the first and third power supply conductors due to the layer of electrically insulating material. By arranging the plurality of first sections and the plurality of second sections in an alternating manner, heat generated by the electrically conductive heating element body due to the electric current flowing between the second power supply conductor (in particular, the plurality of second sections) and the first and third power supply conductors is dispersed along the length of the second power supply conductor.

Each of the plurality of first sections may have a unit length along a length of the second power supply conductor. In particular, the plurality of first sections may be arranged along the length of the second power supply conductor to form a periodic pattern and each of the plurality of first sections may therefore be regarded as a unit of the periodic pattern. A length of each of the plurality of first sections along the length of the second power supply conductor may accordingly be regarded as the unit length. The unit length may be smaller than each of a distance between the second power supply conductor and the first power supply conductor, and a distance between the second power supply conductor and the third power supply conductor.

That is, the unit length may be smaller than each of the first distance and the second distance. This is advantageous for allowing heat generated by the electrically conductive heating element body to spread evenly along the length of the electrical heating cable, such that temperature fluctuations along the electrical heating cable are negligible.

The layer of electrically insulating material may comprise a coating of electrically insulating varnish, lacquer or paint.

The layer of electrically insulating material may comprise a layer of electrically insulating tape. Use of electrically insulating tape, varnish, lacquer or paint allows the conductive area of the second power supply conductor to be precisely controlled, which, in turn, allows the resistance between the second power supply conductor and other power supply conductors to be precisely controlled to a level at which phase imbalance is substantially eliminated.

At least a part of the layer of electrically insulating material may be provided helically around the second power supply conductor.

The layer of electrically insulating material may comprise a plurality of rings spaced apart from each other along the length of the cable.

The electrically conductive heating element body may have a positive temperature coefficient of resistance.

By providing the electrically conductive heating element body with a positive temperature coefficient of resistance, this means that as the heating cable gets hotter, the resistance of the electrically conductive heating element body increases. Subsequently, the current flowing within the heating cable is reduced, causing the temperature of the heating cable to reduce in a corresponding manner. In this way, the heating cable self-regulates its temperature, and overheating or burn-out of the heating cable by the heat generated by itself is effectively prevented, thereby improving the safety of the heating cable.

According to a second aspect of the present invention, there is provided a method of manufacturing an electrical heating cable, comprising: providing a first power supply conductor, a second power supply conductor and a third power supply conductor; covering only a part of a surface of the second power supply conductor with an electrically insulating material; and providing an electrically conductive heating element body, wherein each of the first, second and third power supply conductors extends along a length of the cable and are electrically coupled to each other via the electrically conductive heating element body, and wherein the electrically insulating material is provided between the surface of the second power supply conductor and the electrically conductive heating element body.

The method may further comprise extruding the electrically conductive heating element body over the first, second and third power supply conductors.

The electrically insulating material may comprise an electrically insulating tape. Covering only a part of a surface of the second power supply conductor may comprise wrapping the electrically insulating tape around only a part of a surface of the second power supply conductor.

The electrically insulating material may comprise one of electrically insulating varnish, lacquer or paint. Covering only a part of a surface of the second power supply conductor may comprise applying the one of electrically insulating varnish, lacquer or paint on only a part of a surface of the second power supply conductor.

Covering only a part of a surface of the second power supply conductor may comprise spraying or brushing the electrically insulating material on the surface of the second power supply conductor.

Features described above with reference to the first aspect of the invention may be combined with the second aspect of the invention.

BRIEF DESCRIPTION OF THE DRAWINGS

Embodiments of the invention will now be described, by way of example only, with reference to the accompanying drawings in which.

DETAILED DESCRIPTION

Figure 1:
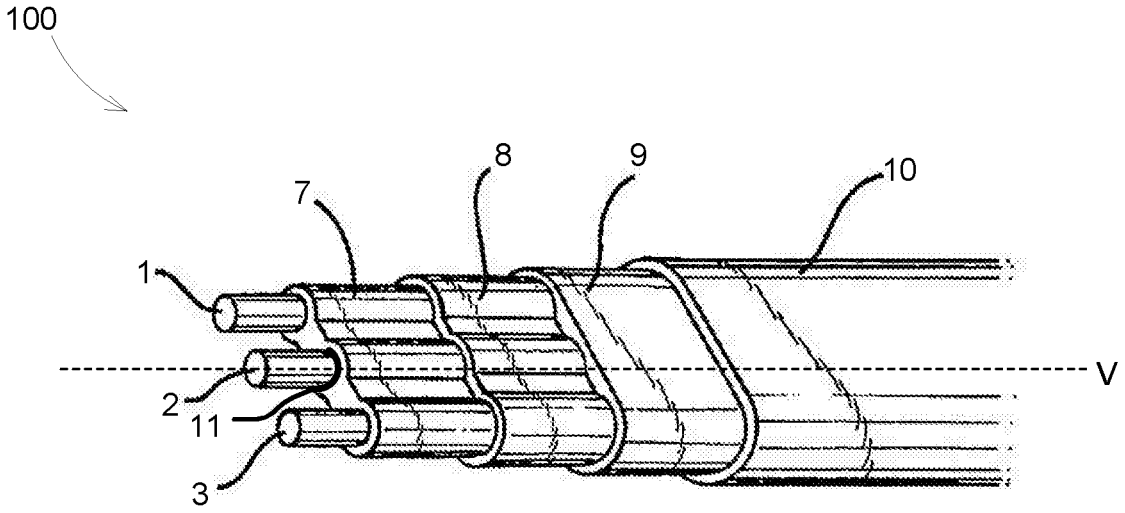
FIG. 1 illustrates an electrical heating cable according to an embodiment of the invention.
Figure 2:
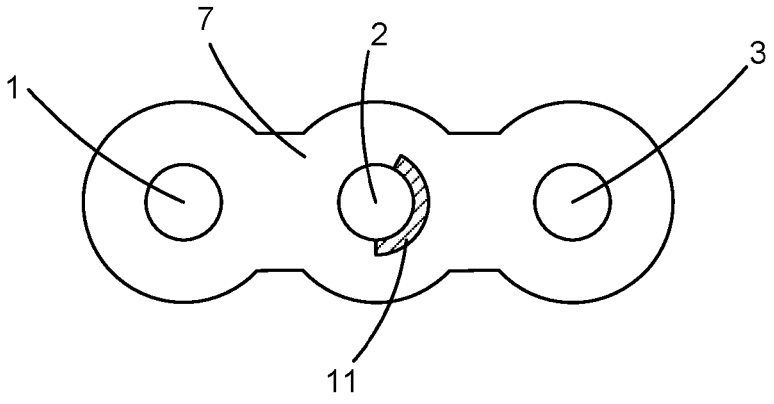
FIG. 2 illustrates a part cross-sectional view of the electrical heating cable of FIG. 1.

FIGS. 1 and 2 depict an electrical heating cable 100 (hereinafter, "the cable 100") in accordance with an embodiment of the present invention. The cable 100 extends along an axis V. The axis V is parallel to a centre-line of the cable 100 and may not be straight. In the following description, the expression of "extending along a length of the cable 100" is deemed as equivalent to "extending along the axis V". As shown in FIG. 1, the cable 100 includes three power supply conductors 1, 2, 3 (hereinafter, "the conductors 1, 2, 3") running along a length of the cable 100.

The conductors 1, 2, 3 are of approximately the same diameter and the same length. The conductors 1, 2, 3 are further in a substantially planar arrangement. That is, the conductors 1, 2, 3 extend alongside one another and lie in substantially the same plane. The conductors 1, 2, 3 are equally spaced from each other. Therefore, a first distance between the first conductor 1 and the second conductor 2 is equal to a second distance between the second conductor 2 and the third conductor 3, and is approximately a half of a third distance between the first conductor 1 and the third conductor 3. In an example, a diameter of each of the conductors 1, 2, 3 is around 2 mm, and the edge-to-edge distance between the first conductor 1 and the second conductor 2 (i.e., the first distance) is around 5 mm, and the edge-to-edge distance between the second conductor 2 and the third conductor 3 (i.e., the second distance) is also around 5 mm. Of course, it will be appreciated that the diameter and the distances may be of other sizes as appropriate.

The second conductor 2, which is between the first and third conductors 1 and 3, is provided with a layer of electrically insulating material 11 (hereinafter, "the layer 11"). Such layer is not provided to cover the first and third conductors 1 and 3. The layer 11 may have a thickness of around 0.05 mm to around 0.5 mm, and may typically have a thickness of around 0.05 mm to around 0.1 mm.

The conductors 1, 2, 3 are further embedded in an electrically conductive heating element body 7 (hereinafter, "the body 7"). FIG. 2 depicts a part cross-sectional view of the cable 100 when the cable is cut along a plane perpendicular to the axis V. For simplicity, only the conductors 1, 2, 3, the layer 11 and the body 7 are shown, with other layers of the cable 100 omitted.

As shown in FIG. 2, the layer 11, which covers the second conductor 2, is also embedded in the body 7. The conductors 1, 2, 3 are electrically coupled to each other via the body 7. The conductors 1, 2, 3 are not directly connected to each other. Therefore, the only available electrically conductive pathways between the conductors 1, 2, 3 are via the body 7.

The conductors 1, 2, 3 may be embedded in the body 7 in any appropriate manner. For example, the body 7 may be extruded over and around the conductors 1, 2, 3. Alternatively, the body 7 may be formed (e.g. moulded) around the conductors 1, 2, 3.

The body 7 is surrounded by an insulating sheath 8. The insulating sheath 8 may be formed by extrusion. The insulating sheath 8 is further surrounded by an electrically conductive covering 9. In this way, the insulating sheath 8 electrically isolates the body 7 from the electrically conductive covering 9. The electrically conductive covering 9 may be in the form of braid, mesh, solid metal extrudate or foil, and may be made from aluminium, aluminium alloy, copper or the like. The electrically conductive covering 9 surrounds the circumference of the insulating sheath 8 continuously and extends along the axis V. The electrically conductive covering 9 improves the mechanical strength and stability of the cable 100, and also enhances the cut resistance of the cable 100. The electrically conductive covering 9 may be connected to the earth ground, thereby providing an electrical pathway to direct any leakage current within the cable 100 safely to the ground.

The electrically conductive covering 9 may be further encased in an insulating jacket 10. The insulating jacket 10 protects the cable 100 from ingress of water, dirt, etc., and electrically insulates the cable 100 from its surroundings.

The conductors 1, 2, 3 are made of an electrically conducting material, such as, copper, steel, aluminium, etc. The body 7 is a polymer material. The polymer material may be formed as a compound of an electrically-insulating polymer (such as, an insulating thermoplastic polymer) and an electrically-conductive filler material. The electrically-conductive filler material may be carbon black. Other material, such as, carbon fibres, nanotubes, graphite, graphene, metal fibres, metal flakes or metal particles may also be used as the filler material, either alone or in combination. The blend of the electrically-conductive filler material into the electrically-insulating polymer allows the polymer material of the body 7 to have conductivity between that of the electrically-insulating polymer and that of the electrically-conductive filler material. The body 7 generally has a much larger resistance than that of the conductors 1, 2, 3.

In use, the conductors 1, 2, 3 are connected to the output phases of a three-phase power supply (not shown), respectively. An electric current flows out of the power supply, through each of the conductors 1, 2, 3, and the body 7, and flows back to the power supply via a different one of the conductors 1, 2, 3. According to Joule's first law, the passage of an electric current through an electrical conductor produces heat, and the power of heating is proportional to the resistance of the conductor and the square of the current. Since the body 7 has a much larger resistance than that of the conductors 1, 2, 3, the heat generated by the conductors 1, 2, 3 is negligible compared to that generated by the body 7. The body 7 therefore generates majority of the heat output by the cable 100.

The compound of an electrically-insulating polymer and an electrically-conductive filler material may have a positive temperature coefficient of resistance. That is, the electrical resistance of the body 7 may increase with the temperature of the body 7. This is generally desirable for reasons of safety. When the cable 100 gets hotter, the resistance of the body 7 increases. Subsequently, the current flowing within the cable 100 is reduced, causing the temperature of the cable 100 to reduce in a corresponding manner. In this way, the cable 100 self-regulates its temperature, and overheating or burn-out of the cable 100 by the heat generated by itself is effectively prevented, thereby improving the safety of the cable 100.

It will be appreciated that the cable 100 may include an active heating region which extends along the axis V of the cable 100. The active heating region, in use, generates heat for heating up a workpiece. The active heating region may form a main body of the electrical heating cable. The cable 100 may further comprise a connection region for connecting the cable 100 to a three-phase power supply. The connection region may be provided at an end of the active heating region. Since the body 7 generates majority of the heat output by the cable 100 as described above, each of the conductors 1, 2, 3 are embedded in the body 7 and may be even entirely surrounded by the body 7 at the active heating region, in order to maximise the heat output by the cable 100. At the connection region, it will be appreciated the conductors 1, 2, 3 may extend beyond the body 7 to connect to the three-phase power supply.

Figure 3:
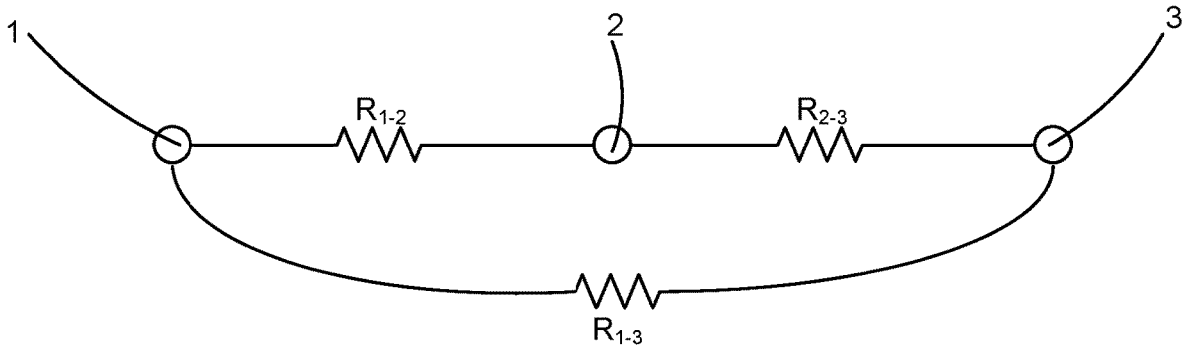
FIG. 3 illustrates an equivalent circuit of the electrical heating cable of FIG. 1.

FIG. 3 shows an equivalent circuit of the electrical heating cable 100. Resistor $R_{1-2}$ denotes the equivalent resistance between the first conductor 1 and the second conductor 2. Resistor $R_{2-3}$ denotes the equivalent resistance between the second conductor 2 and the third conductor 3. Resistor $R_{1-3}$ denotes the equivalent resistance between the first conductor 1 and the third conductor 3. For simplicity, the resistances of the conductors 1, 2, 3 themselves are neglected and the resistances of the resistors $R_{1-2}$, $R_{2-3}$ and $R_{1-3}$ are treated as resulting from the resistance of the body 7 alone. It will be appreciated that if the cable 100 is balanced, the resistances of $R_{1-2}$, $R_{2-3}$ and $R_{1-3}$ should be substantially equal to each other. In this way, the cable 100 will have electrically conductive pathways with equal resistance across the three conductors 1, 2, 3 and accordingly will draw equal currents from each phase of a three-phase power supply. Therefore, the resistances of $R_{1-2}$, $R_{2-3}$ and $R_{1-3}$ provide a good indication as to whether the cable 100 is balanced.

If, within the cable 100, the layer 11 is omitted, it has been found that the resistance of $R_{1-3}$ is approximately two times the resistance of $R_{1-2}$ or $R_{2-3}$. This is because the resistances of $R_{1-2}$, $R_{2-3}$ and $R_{1-3}$ result from the resistance of the body 7, and assuming the material of the body 7 has uniform resistivity, the length of conductive path between the first conductor 1 and the third conductor 3 is approximately two times the length of conductive paths between the second conductor 2 and each of the first and third conductors 1, 3. Therefore, the cable 100 will be unbalanced without the layer 11.

The layer of electrically insulating material 11 is thus provided to reduce the imbalance of the cable 100, and preferably to make the heating cable balanced for use with a three-phase power supply.

Figure 4:
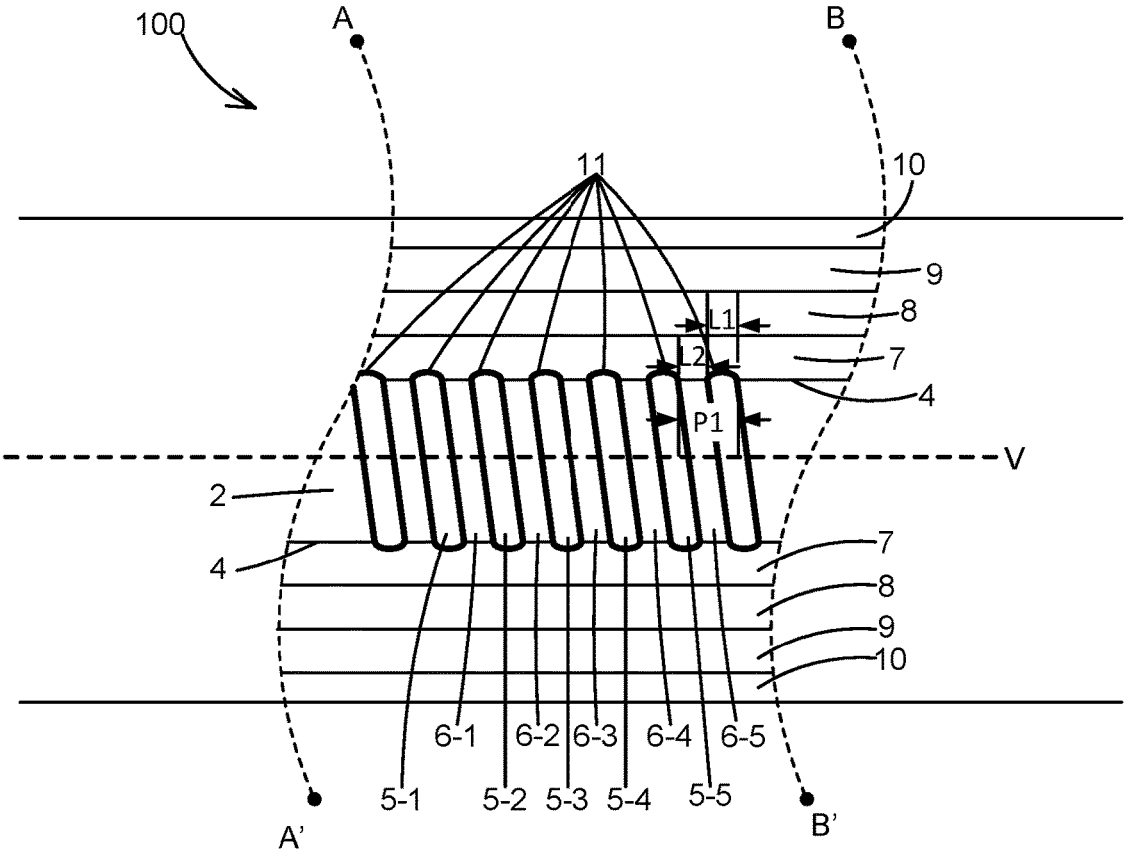
FIG. 4 illustrates a side-on part cutaway view of the electrical heating cable of FIG. 1.

FIG. 4 depicts the side-on cut-away view of the cable 100 between the cut-away lines A-A' and B-B'.

As shown in FIG. 4, the second conductor 2 extends along the axis V and has a surface 4 covered by (i.e., embedded in) the body 7. The surface 4 is an outer circumferential surface of the second conductor 2, and is completely enclosed by the body 7. The axis V extends along a length of the second conductor 2 and also extends along a length of the cable 100.

As described above, the second conductor 2 may protrude through ends of the body 7 and therefore may have a length greater than that of the body 7 along the axis V. In that case, the surface 4 which is covered by the body 7 is a part of the entire outer circumferential surface of the second conductor 2.

As further shown in FIG. 4 the layer 11 is provided helically around the second conductor 2. The layer 11 is therefore provided between the surface 4 of the second conductor 2 and the body 7. The layer 11 does not cover the surface 4 of the second conductor 2 entirely and instead covers only a part of the surface 4.

In particular, in the illustration of FIG. 4, the layer 11 covers a plurality of sections 5-1, 5-2, 5-3, 5-4, 5-5 (referred to as "sections 5" collectively) of the surface 4, and does not cover a plurality of sections 6-1, 6-2, 6-3, 6-4, 6-5 (referred to as "sections 6" collectively) of the surface 4. The covered sections 5 and uncovered sections 6 listed above are clearly not exhaustive and are merely used here as an example for the ease of description. The covered sections 5 and the uncovered sections 6 alternate along the axis V, such that each covered section is sandwiched between two uncovered sections, and vice versa. Each of the covered sections 5 has a unit length L1 along the axis V. Each of the uncovered sections 6 has a unit length L2 along the axis V. In this example, the unit length L1 and the unit length L2 are equal. In this way, by providing the layer 11 along the length of the second conductor 2 such that the covered sections 5 and uncovered sections 6 are distributed evenly, the layer 11 covers approximately 50% of the area of the surface 4.

It will be appreciated that although the covered sections 5 are depicted as being separated from each other in FIG. 4, adjacent ones of the covered sections 5 are actually connected to each other at the opposite side of the second conductor 2 (not shown FIG. 4), such that the covered sections 5 form a continuous helical shape around the second conductor 2. As shown in FIG. 4, the helical shape formed by the layer 11 has a pitch P1. The length of the pitch P1 is equal to a sum of the unit length L1 and the unit length L2. The helix angle (i.e., the angle between each of the covered sections 5 and the axis V) of the layer 11 may be typically between 30° and 60°.

Since the sections 5 of the surface 4 are covered by the layer 11, the sections 5 are electrically insulated from the body 7 by the layer 11. The sections 6, which are uncovered by the layer 11, remain in electrical connection with the body 7. The layer 11 therefore effectively reduces the electrically-conductive area of the second conductor 2. Without the layer 11, the electrically-conductive area is equal to 100% of the area of the surface 4. With the layer 11 covering approximately 50% of the area of the surface 4, the electrically-conductive area is reduced to around 50% of the area of the surface 4.

It has been found that the electrically-conductive area of the second conductor 2 affects the equivalent resistances $R_{1-2}$, $R_{2-3}$ between the second conductor 2 and the first and third conductors 1, 3, as described in more detail below.

Figure 5:
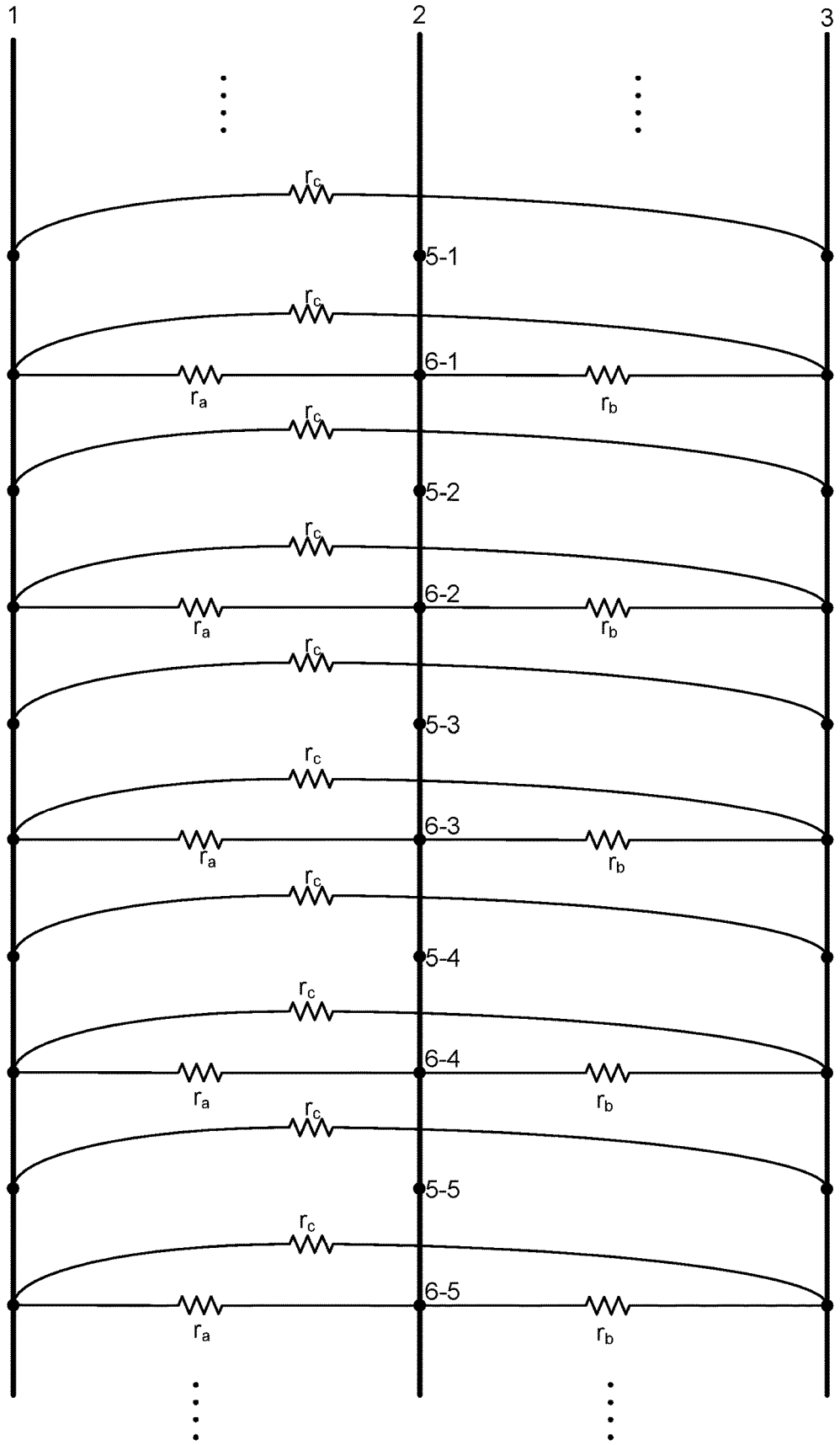
FIG. 5 illustrates a schematic circuit diagram of electrical connections in the electrical heating cable of FIG. 1.

FIG. 5 shows a schematic circuit diagram modelling the electrical connections between the first conductor 1, the second conductor 2 and the third conductor 3.

In the circuit diagram, each of the conductors 1, 2, 3 is virtually separated to ten exemplary conductive sections along the length of the cable 100, which correspond to the sections 5-1, 6-1, 5-2, 6-2, 5-3, 6-3, 5-4, 6-4, 5-5, 6-5 of the conductor 2 shown in FIG. 4.

As described above, the resistances of the conductors 1, 2, 3 are much smaller than that of the body 7, and the resistance of the conductors 1, 2, 3 are therefore neglected in the circuit diagram of FIG. 5.

As shown in FIG. 5, five electrical pathways exist between the uncovered sections 6-1, 6-2, 6-3, 6-4, 6-5 of the second conductor 2 and corresponding sections of each of the first and third conductors 1, 3. The resistance of each pathway between the conductors 1 and 2 is denoted as $r_a$, and the resistance of each pathway between the conductors 2 and 3 is denoted as $r_b$. The electrical pathways are provided by the body 7 and therefore, assuming the material of the body 7 is uniform, all of the electrical pathways have the same resistivity. Given that the conductors 1, 3 are equally spaced from the conductor 2 as described above, the resistance of $r_a$ is substantially equal to that of $r_b$. There is no electrical pathway originating from the covered sections 5-1, 5-2, 5-3, 5-4, 5-5 of the conductor 2 since those sections are covered by the layer 11. Since the pathways between the second conductor 2 and each of the first and third conductors 1, 3 are parallel, the equivalent resistance $R_{1-2}$ between the second conductor 2 and the first conductor 1 is approximately equal to $r_a$ divided by five, and the equivalent resistance $R_{2-3}$ between the second conductor 2 and the third conductor 3 is approximately equal to $r_b$ divided by five.

The electrical connections between the first conductor 1 and the third conductor 3 are not affected by the layer 11 which is only provided on the second conductor 2. Therefore, as shown in FIG. 5, there are ten electrical pathways therebetween, with the resistance of each pathway being denoted as $r_c$. With ten pathways in parallel, the equivalent resistance $R_{1-3}$ between the first conductor 1 and the third conductor 3 is approximately equal to $r_c$ divided by ten. However, since the length of each electrical pathway between the conductors 1, 3 is approximately two times the length of each electrical pathway between the conductors 1, 2 (or between the conductors 2, 3), the resistance of $r_c$ is approximately two times the resistance of $r_a$ or $r_b$. Therefore, with the layer 11, $R_{1-2}$, $R_{2-3}$ and $R_{1-3}$ have substantially equal resistance. That is, the cable 100 is balanced due to the layer 11.

It will be appreciated that the schematic circuit diagram shown in FIG. 5 are merely employed to assist the explanations as to why the layer 11 reduces the imbalance of the cable 100, and are not bound by any theory. The schematic circuit diagram shown in FIG. 5 is not intended for use as a precise model of the electrical connections between the conductors 1, 2, 3.

In light of the above, by arranging the layer 11 to cover approximately 50% of the surface 4 of the second conductor 2, the second conductor 2 has a smaller conductive area for electrically coupling to each of the first and third conductors 1, 3 via the body 7. In particular, the conductive area of the second conductor 2 is reduced to approximately 50% of the whole area of the surface 4. Accordingly, due to the reduction of conductive area of the second conductor 2, the electrical resistances $R_{1-2}$, $R_{2-3}$ between the second conductor 2 and each of the first and third conductors 1, 3 are approximately two times their original values when the layer 11 is not provided. In this way, the layer 11 has doubled the electrical resistances of $R_{1-2}$, $R_{2-3}$ to approximately the same level as the electrical resistance of $R_{1-3}$, thereby making the cable 100 balanced and improving the efficiency of the cable 100.

Without being bound by any theory, it is believed that if the area of the layer 11 is enlarged to cover a larger proportion of the surface 4 of the second conductor 2, the second conductor 2 has less conductive area for electrically coupling to the first and third conductors 1, 3 via the body 7. Accordingly, the resistance between the second conductor 2 and each of the first and third conductors 1, 3 will increase. Conversely, the resistance between the second conductor 2 and each of the first and third conductors 1, 3 will decrease by reducing the area of the layer 11 to cover a smaller proportion of the surface 4 of the second conductor 2. In this way, the electrical resistance between the second conductor 2 and each of the first and third conductors 1, 3 can be easily adjusted to a desired level, by simply adjusting the area of layer 11.

The unit length L1 of the covered sections 5 is between about 2 mm and about 3 mm. Of course, it will be appreciated that the unit length L1 may be of other sizes as appropriate.

The unit length L1 of the covered sections 5 may be smaller than each of the first distance between the second conductor 2 and the first conductor 1 and the second distance between the second conductor 2 and the third conductor 3. As described above, due to the layer 11, there are no electrical pathways originating from the covered sections 5 to the regions of the body 7 immediately adjacent to the sections 5. Therefore, the regions of the body 7 immediately adjacent to the sections 5 only conduct very limited amount of electrical current in use and tends to generate less heat than the regions of the body 7 immediately adjacent to the uncovered sections 6. By making the unit length L1 of the covered sections 5 small relative to the first and second distances, it facilitates heat transfer between the regions of the body 7 immediately adjacent to the sections 5 and the regions of the body 7 immediately adjacent to the uncovered sections 6 and allows heat generated by the body 7 to spread evenly along the length of the cable 100. In this way, temperature fluctuations along the length of the cable 100 caused by the layer 11 are minimised and heat output along the axis V of the cable 100 is substantially uniform. In particular, where the unit length L1 of the covered sections 5 is much smaller than each of the first and second distances, temperature fluctuations may be considered negligible.

The layer 11 may be made of any appropriate electrically insulating material, such as but not limited to, polymers, compounds, etc., and may be applied to the second conductor 2 in any suitable way not limited to the two examples provided below.

The layer 11 may have a resistivity at least 10 times the resistivity of the body 7. It has been found that when the layer 11 is 10 times more resistive than the body 7, the phase imbalance within the cable 100 is reduced by 90%. Increasing the resistivity of the layer 11 is beneficial for further improving the balance within the cable 100. Ideally, the layer 11 may have a resistivity at least $10^{10}$ times the resistivity of the body 7. In an example, the body 7 has a resistivity of the order of around $10^3$ to $10^4$ Ω·m, and the layer 11 has a resistivity of the order of around $10^{15}$ to $10^{16}$ Ω·m.

In an example, an electrically insulating varnish may be used to form the layer 11. The insulating varnish may be applied to the second conductor 2 using a brush. By rotating the brush around the second conductor 2 and at the same time moving the brush along the axis V of the second conductor 2, a helical shaped coating like the layer 11 is formed on the surface 4 of the second conductor 2. The helical shaped coating may further be fully cured (and post-cured if necessary) before the second conductor 2 is embedded in the body 7. Alternatively, rather than using a brush, a spray head may be used to apply the insulating varnish to the surface 4 of the second conductor 2. The spray head may rotate around the second conductor 2 while moving along the length of the second conductor 2 to form the layer 11. The spray head used to form the layer 11 may be a pulsed intermittent spray head. The unit length L1 and the unit length L2 may have a length of about 0.5 mm. Therefore, uniformity of heat output along the axis V of the cable 100 may be further improved by using a spray head to apply the layer 11. Further, an electrically insulating lacquer or paint may be used to form the layer 11.

In another example, an electrically insulating tape, which may be optionally provided with an adhesive layer, may be used to form the layer 11. The electrically insulating tape may be wrapped helically around the second conductor 2 to cover a part (e.g., 50%) of the surface 4 of the second conductor 2, before the second conductor 2 is embedded in the body 7. A width of the electrically insulating tape may be around 2 mm. Plastic sheets, such as for example, Mylar™ and Kapton™, may be used to form the electrically insulating tape. It is convenient to apply the electrically insulating tape made from such plastic sheets to the conductor 2 and is also relatively easy to remove such tape from the conductor 2 (for example, in order to connect the conductor 2 to a power supply). Where an adhesive layer is provided, the adhesive layer may be considered to form an intermediate layer between the layer 11 and the second conductor 2.

In the above described embodiment, the conductors 1, 2, 3 are embedded in the body 7. However, alternative arrangements are possible. For example, a first part of the body 7 may extend along the cable 100 between and electrically coupling the conductors 1, 2; second and third parts of the body 7 may extend between the conductors 1, 3 and the conductors 2, 3. That is, the body 7 may not completely surround each of the conductors. It is however preferable that the conductors 1, 2, 3 are embedded in the body 7 to ensure that uniform electrical connections are made between each of the conductors 1, 2, 3.

Further, in the above described embodiment, the conductors 1, 2, 3 are in a substantially planar arrangement with the conductors 1, 3 equally spaced from the conductor 2. It will be appreciated, however, that alternative arrangements are possible. For example, the conductors 1, 3 may be spaced from the conductor 2 at different distances. In a further example, the conductors 1, 2, 3 may not lie in the same plane, and instead may be in a triangular arrangement in a cross-sectional view of the cable 100. As long as the distances between each pair of the conductors 1, 2, 3 are not equal, the cable 100 faces the same imbalance problem as described above and the layer 11 will be beneficial to reduce the imbalance of the cable 100.

It is however preferable that the conductors 1, 2, 3 are in a substantially planar arrangement, which allows the cable 100 to have a relatively flat cross-sectional shape, thereby increasing the contact area between the cable 100 and a workpiece to be heated. In this way, the cable 100 is highly efficient in transferring heat to the workpiece. Further, when the conductors 1, 2, 3 are in a substantially planar arrangement, the cable 100 tends to be more flexible than the case where the conductors 1, 2, 3 are in a different arrangement, e.g., a triangular arrangement, and to be easier to install around a workpiece to be heated. Accordingly, bending stresses generated within the cable 100 during installation are also reduced and accordingly premature failure of the cable 100 is reduced or prevented.

It will further be appreciated that the layer 11 may cover a percentage, different from 50% as described above, of the area of the surface 4 in order to make the cable 100 balanced, depending upon the particular arrangement of the conductors 1, 2, 3. For example, in the planar arrangement of the conductors 1, 2, 3 depicted in FIGS. 1 and 2, if the diameter of the conductors 1, 2, 3 is of the same (or similar) order as the first distance between conductors 1, 2 or the second distance between the conductors 2, 3, the length of conductive path formed by the body 7 between the conductors 1, 3 will be inevitably longer than two times the length of conductive paths formed by the body 7 between the conductor 2 and each of the conductors 1, 3. Accordingly, the layer 11 should preferably cover more than 50% of the area of the surface 4 so as to increase the electrical resistances $R_{1-2}$, $R_{2-3}$ to be more than two times their original values when the layer 11 is not provided, in order to make the cable balanced. To vary the coverage percentage of the layer 11, the unit length L1 of the covered sections 5 on the surface 4 may be adjusted to be different from the unit length L2 of the uncovered sections 6, for example.

It will also be appreciated that a layer of electrically insulating material similar to the layer 11 may be provided on either or both of the conductors 1, 3 as well, such that more than one of the conductors 1, 2, 3 are covered with the electrically insulating material. Covering more than one of the conductors may be desirable if, for example, the distances between the conductors 1, 2, 3 are all different from each other, in order to minimise the load imbalance across the conductors 1, 2, 3.

Indeed, in general terms, it is possible to manipulate the resistance between a plurality of power supply conductors within a heating cable to have predetermined values by applying a layer of electrically insulating material to one or more of those conductors, the layer(s) configured to obstruct a portion of the electrically conducting area of the one or more conductors.

It has been found that, in some circumstances, applying the layer(s) of electrically insulating material around the conductor(s) achieves better performance than applying layer(s) of electrically-conductive material around the conductor(s), with the electrically conductive material having a higher electrical resistivity than that of the body 7.

In particular, a highly resistive electrically-conductive material may be provided to cover the conductor(s) to manipulate the resistance between the conductors so as to reduce the load imbalance of a heating cable. However, this method may be less advantageous than the embodiments described above. Firstly, the layer of highly resistive electrically-conductive material may take up a substantial volume of space within the cable in order to reduce the load imbalance, with the covered conductor having a smaller diameter to accommodate the resistive layer (for a cable with fixed outer dimensions). The covered conductor may thus have a smaller cross-sectional area than the uncovered conductors. In order to make the conductors have the same cross-sectional area, all conductors must be reduced in size to make room for the layer of highly resistive electrically-conductive material. Because of the reduced cross-sectional area of the conductors, voltage drop along a unit length of the cable is increased, and the maximum length of cable which can be powered from a particular power supply is substantially reduced.

Secondly, the resistance of each of the highly resistive electrically-conductive material and the electrically conductive heating element body 7 may be sensitive to temperature variations (e.g. having a PTC characteristic). However, it will be appreciated that the resistance characteristics of the highly resistive electrically-conductive material and the electrically conductive heating element body may be different, and the relative resistivity of the two materials may thus change as a function of temperature. Temperature variations can thus result in a deterioration of the balanced status of a cable when the balancing is achieved by the layer of highly resistive electrically-conductive material at a particular temperature point or range.

On the other hand, the layer of electrically insulating material has a substantially temperature-insensitive electrical performance. Therefore, with the layer of electrically insulating material, a cable can remain balanced all the time, without being influenced by temperature variations. Further, the layer(s) of electrically insulating material can be relatively thin (e.g. between 0.05 mm to 0.1 mm) and will therefore not take up a substantial volume of space within the cable. In contrast, the highly resistive electrically-conductive material typically requires a thickness of around 0.2 mm to 0.5 mm. Moreover, the process of applying the layer(s) of electrically insulating material around conductor (s) is easily controllable, using for example the exemplary techniques described above.

The first distance and the second distance described above may be with reference to a voltage level of a power supply to which the cable 100 is connected. As described above, the resistance of $R_{1-2}$ is generally proportional to the first distance, and the resistance of $R_{2-3}$ is generally proportional to the second distance. If the conductors 1, 2, 3 are connected to a power supply which has a high voltage level, a large current will flow through the body 7 and there is a risk that the large current will lead to a breakdown of the body 7. If the body 7 is made of the polymer material described above, it has been found that each millimetre of the body 7 between a pair of conductors may typically withstand an rms voltage of around 100V. Therefore, if the cable 100 is connected to a three-phase power supply which provides an rms voltage of up to 600V across any two phases, each of the first distance and the second distance is preferably around 5 mm to 6 mm. It will be understood that if the cable 100 is connected to a power supply outputting a lower voltage, the first distance and the second distance may be reduced accordingly.

Figure 6:
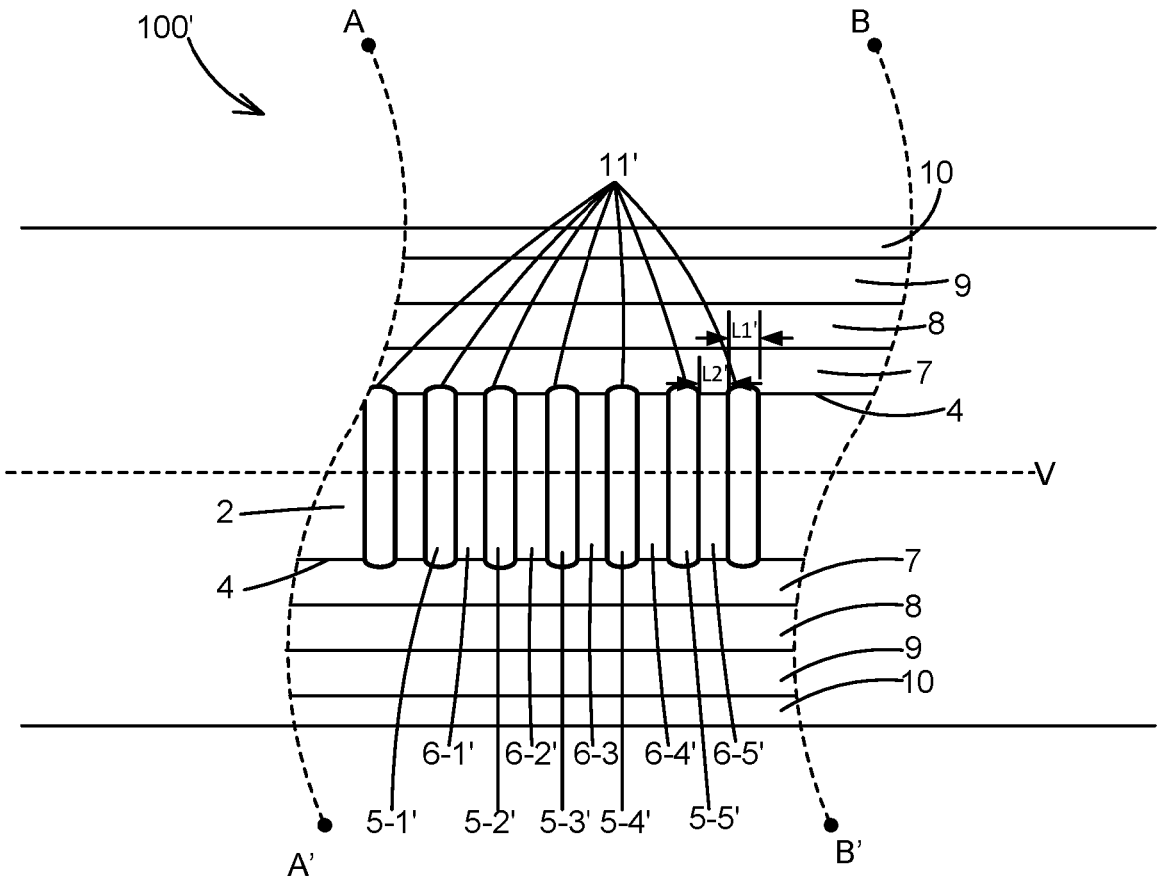
FIG. 6 illustrates a side-on part cutaway view of an electrical heating cable according to an alternative embodiment of the invention.

In the above embodiment, the layer 11 forms a single continuous helix around the second conductor 2. It will be appreciated that the layer 11 may be formed around the second conductor 2 in a different manner. For example, the layer 11 may form a plurality of helixes around the second conductor 2 along the axis V. In particular, the layer 11 may comprise multiple parts spaced along the axis V. Each part wraps around the second conductor 2 to form a helix having a particular pitch. Adjacent parts of the layer 11 along the axis V may be completely separated or may be connected to each other by, for example, the electrically insulating material. FIG. 6 illustrates another example of the layer of electrically insulating material. In FIGS. 4 and 6, like components are denoted by like reference numerals. As shown in FIG. 6, the layer of electrically insulating material 11' forms a plurality of rings 5-1', 5-2', 5-3', 5-4', 5-5' spaced apart from each other along the axis V. Neighbouring rings are separated by sections 6-1', 6-2', 6-3', 6-4' 6-5' which are uncovered by the layer 11'. Each of the uncovered sections is also of a ring shape. Each ring has a length of L1' along the axis V. Each uncovered section has a length of L2' along the axis. It will be appreciated that irrespective of the particular shape of the layers 11, 11', each of the layers 11, 11' covers only a part of the surface 4 and by adjusting the coverage percentage of each of the layers 11, 11' on the surface 4, the electrical resistance between the conductor 2 and the conductors 1, 3 are adjusted accordingly as described above.

It will be appreciated that the conductors 1, 2, 3 and the body 7 may be made of any suitable materials, not limited to the examples described above. Further, it will be appreciated that the body 7 may have a different temperature coefficient of resistance from that described above. For example, the body 7 may be made of a blended material having negative temperature coefficient of resistance when the temperature is low and having positive temperature coefficient of resistance when the temperature is high. An example of such a blended material is described in WO 2007/132256 A1.

In an example, the cable 100 may have a power output of around 10 Watts per metre length (10 W/m) per phase, thereby achieving total power output of around 30 W/m due to its three-phase configuration. If a cross-sectional size of each of the conductors 1, 2, 3 is around 1.2 $mm^2$, and a standard mains voltage of 230 V is used as the power supply, the maximum circuit length of the cable 100 can reach around 300 metres. It will be appreciated that if a higher-voltage power supply (such as those commonly used in the industrial applications) is employed, the cable 100 can achieve a longer maximum circuit length of the order of a kilometre. It is common for pipes used between industrial plants to have a length of several hundred metres to a few kilometres (e.g., 600*m*, or 2 km). Therefore, the cable 100 has increased suitability for use in large scale industrial applications.

The cable 100 described above may be more efficient than a single-phase heating cable. A single-phase heating cable generally includes a pair of conductors extending in parallel along the length of the cable, with an electrically conductive polymeric material (for example, the body 7) provided between the pair of conductors. In order for a single-phase heating cable to achieve the same power output of around 30 W/m with conductors of the same cross-sectional size and under the same 230V power supply, the current flowing through the single-phase heating cable should be three times as much as the current flowing through each phase of the cable 100. Accordingly, the voltage drop on the conductors of the single-phase heating cable also triples and the maximum circuit length of the single-phase heating cable is therefore limited to around 100 metres. To increase the maximum circuit length of the single-phase heating cable to 300 metres under the same power supply, it is required to triple the cross-sectional size of each of the pair of conductors by using more conductive material. Therefore, compared to a single-phase heating cable, the cable 100 is able to transmit an equivalent amount of power to a single-phase equivalent setup with less conductor material and is therefore more efficient to achieve a circuit length satisfying the length requirements to heating cables in industrial applications (in particular, large scale industrial applications).

The cable 100 described above also has better performance than a conventional three-phase series resistance heating cable arrangement. A conventional three-phase series resistance heating cable arrangement generally includes three conductors extending in parallel along the length of the cable, the three conductors each being embedded within a separate body of electrically insulating material. Remote ends of the three conductors are electrically connected together to form a star point. In use, ends of the conductors opposite to the star point are separately connected to three phases of a three-phase power supply. In a series resistance heating cable, it is the conductors that generate the heat output by the cable 100, rather than any material provided between the conductors.

Although the series resistance heating cable arrangement can achieve a circuit length of several kilometres, it cannot self-regulate its temperature in the way that the cable 100 does (due to the positive temperature coefficient of resistance of the body 7), and therefore requires additional temperature controls to ensure temperature safety. Further, due to the fact that remote ends of the three conductors are electrically connected together, the series resistance heating cable arrangement cannot be cut to length in use and is normally provided with a fixed length. Moreover, it is often necessary to modify the design of a series resistance heating cable arrangement, for example, by modifying a length and/or a cross-sectional area of each conductor, in order to allow the series resistance heating cable to be used in a particular application. Therefore, a series resistance heating cable is typically designed to length and it may be difficult to use one design of a series resistance heating cable for different applications.

In contrast, the cable 100 can be conveniently cut to length in use, by removing, for example, a length at a remote end of the cable 100. Further, the conductors 1, 2, 3 of the cable 100 are used for transmitting electrical power to the body 7, but are not used for generating heat. Therefore, as long as the resistances of the conductors 1, 2, 3 are controlled to be relatively small, it is possible to use a particular design of the cable 100 for multiple applications. As a result, the cable 100 may be flexibly used for a range of different applications and needs not be redesigned for each application.

As shown in FIG. 2, the layer 11 is in contact with the surface of the second conductor 2, and is further in contact with the body 7. However, it will be understood that the layer 11 does not need to be in direct contact with the surface of the second conductor 2. Similarly, the layer 11 does not need to be in contact with the body 7. For example, a first intermediate layer may be provided between the layer 11 and the surface of the second conductor 2. The first intermediate layer may comprise an adhesive layer which makes the layer 11 adhere to the surface of the second conductor 2. Further, the first intermediate layer may comprise a layer of electrically conductive material, which is electrically coupled to the second conductor 2. Similarly, a second intermediate layer may be provided between the layer 11 and the body 7. The second intermediate layer may comprise a layer of electrically conductive material, which is electrically coupled to the body 7.

While various embodiments have been described above it will be appreciated that these embodiments are for all purposes exemplary, not limiting. Various modifications can be made to the described embodiments without departing from the scope of the present invention.

The invention claimed is:

1. An electrical heating cable, comprising:

a first power supply conductor;

a second power supply conductor;

a third power supply conductor, wherein each of the first, second and third power supply conductors extends along a length of the cable, wherein the second power supply conductor is spaced from the first power supply conductor by a first distance, the second power supply conductor is spaced from the third power supply conductor by a second distance, the first power supply conductor is spaced from the third power supply conductor by a third distance, and wherein the third distance is greater than the first distance and the second distance;

an electrically conductive heating element body, wherein the first, second and third power supply conductors are electrically coupled to each other via the electrically conductive heating element body;

wherein the second power supply conductor is provided with a layer of electrically insulating material which covers only a part of a surface of the second power supply conductor, the layer being provided between the surface of the second power supply conductor and the electrically conductive heating element body, wherein the layer of electrically insulating material is configured to limit a proportion of the surface of the second power supply conductor which is electrically coupled to the electrically conductive heating element body, such that an area of a surface of the second power supply conductor which is uncovered by the layer of the electrically insulating material is less than each of: an area of a surface of the first power supply conductor which is electrically coupled to the electrically conductive heating element body, and an area of a surface of the third power supply conductor which is electrically coupled to the electrically conductive heating element body.

2. The electrical heating cable according to claim 1, wherein the first, second and third power supply conductors are embedded in the electrically conductive heating element body.

3. The electrical heating cable according to claim 1, wherein the first, second and third power supply conductors are not directly connected to one another.

4. The electrical heating cable according to claim 1, wherein the first, second and third power supply conductors extend alongside one another in a substantially planar arrangement.

5. The electrical heating cable according to claim 4, wherein the second power supply conductor is located between the first and third power supply conductors.

6. The electrical heating cable according to claim 4, wherein the first and third power supply conductors are equally spaced from the second power supply conductor.

7. The electrical heating cable according to claim 1, wherein the layer of electrically insulating material covers substantially 50% of the surface of the second power supply conductor.

8. The electrical heating cable according to claim 1, wherein the surface of the second power supply conductor comprises a plurality of first sections and a plurality of second sections arranged in an alternating manner along a length of the second power supply conductor, wherein the plurality of first sections are covered by the layer of electrically insulating material and the plurality of second sections are not covered by the layer of electrically insulating material.

9. The electrical heating cable according to claim 8, wherein each of the plurality of first sections has a unit length along a length of the second power supply conductor, and wherein the unit length is smaller than each of a distance between the second power supply conductor and the first power supply conductor, and a distance between the second power supply conductor and the third power supply conductor.

10. The electrical heating cable according to claim 1, wherein the layer of electrically insulating material comprises a coating of electrically insulating varnish, lacquer or paint.

11. The electrical heating cable according to claim 1, wherein the layer of electrically insulating material comprises a layer of electrically insulating tape.

12. The electrical heating cable according to claim 1, wherein at least a part of the layer of electrically insulating material is provided helically around the second power supply conductor.

13. The electrical heating cable according to claim 1, wherein the layer of electrically insulating material comprises a plurality of rings spaced apart from each other along the length of the cable.

14. The electrical heating cable according to claim 1, wherein the electrically conductive heating element body has a positive temperature coefficient of resistance.

15. The electrical heating cable according to claim 1, wherein the layer of electrically insulating material is not provided between the surface of the first power supply conductor and the electrically conductive heating element body, or between the surface of the third power supply conductor and the electrically conductive heating element body.

16. A method of manufacturing an electrical heating cable, comprising:

providing a first power supply conductor, a second power supply conductor and a third power supply conductor, wherein the second power supply conductor is spaced from the first power supply conductor by a first distance, the second power supply conductor is spaced from the third power supply conductor by a second distance, the first power supply conductor is spaced from the third power supply conductor by a third distance, and wherein the third distance is greater than the first distance and the second distance;

covering only a part of a surface of the second power supply conductor with an electrically insulating material; and providing an electrically conductive heating element body, wherein each of the first, second and third power supply conductors extends along a length of the cable and are electrically coupled to each other via the electrically conductive heating element body, and wherein the electrically insulating material is provided between the surface of the second power supply conductor and the electrically conductive heating element body; and wherein the electrically insulating material is configured to limit a proportion of the surface of the second power supply conductor which is electrically coupled to the electrically conductive heating element body, such that an area of a surface of the second power supply conductor which is uncovered by the electrically insulating material is less than each of: an area of a surface of the first power supply conductor which is electrically coupled to the electrically conductive heating element body, and an area of a surface of the third power supply conductor which is electrically coupled to the electrically conductive heating element body.

17. The method of manufacturing an electrical heating cable according to claim 16, further comprising:

extruding the electrically conductive heating element body over the first, second and third power supply conductors.

18. The method of manufacturing an electrical heating cable according to claim 16, wherein the electrically insulating material comprises one of electrically insulating varnish, lacquer or paint, and wherein covering only a part of a surface of the second power supply conductor comprises applying the one of electrically insulating varnish, lacquer or paint on only a part of a surface of the second power supply conductor.

19. The method of manufacturing an electrical heating cable according to claim 16, wherein covering only a part of a surface of the second power supply conductor comprises spraying or brushing the electrically insulating material on the surface of the second power supply conductor.

20. A method of manufacturing an electrical heating cable, comprising:

providing a first power supply conductor, a second power supply conductor and a third power supply conductor, wherein the second power supply conductor is spaced from the first power supply conductor by a first distance, the second power supply conductor is spaced from the third power supply conductor by a second distance, the first power supply conductor is spaced from the third power supply conductor by a third distance, and wherein the third distance is greater than the first distance and the second distance;

covering only a part of a surface of the second power supply conductor with an electrically insulating material, wherein a coverage percentage of the electrically insulating material is based upon the first distance, the second distance and the third distance, such that an electrical resistance between any pair of the first, second or third power supply conductors through an electrically conductive heating element body is approximately the same; and embedding the first, second and third power supply conductors in the electrically conductive heating element body.

* * * * *